US010934762B2

(12) United States Patent
Ghannam et al.

(10) Patent No.: US 10,934,762 B2
(45) Date of Patent: Mar. 2, 2021

(54) SYSTEMS AND METHODS FOR PREVENTING GARAGE DOOR FROM CLOSING ON OPENED-LIFTGATE

(71) Applicant: Ford Global Technologies, LLC, Dearborn, MI (US)

(72) Inventors: Mahmoud Yousef Ghannam, Canton, MI (US); Brian Bennie, Sterling Heights, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 287 days.

(21) Appl. No.: 15/958,622

(22) Filed: Apr. 20, 2018

(65) Prior Publication Data

US 2019/0323280 A1 Oct. 24, 2019

(51) Int. Cl.

| | |
|---|---|
| ***E05F 15/668*** | (2015.01) |
| ***E05F 15/77*** | (2015.01) |
| ***E05F 15/42*** | (2015.01) |
| *E05F 15/73* | (2015.01) |

(52) U.S. Cl.

CPC ..... *E05F 15/668* (2015.01); *E05F 15/42* (2015.01); *E05F 15/77* (2015.01); *E05F 2015/767* (2015.01); *E05Y 2400/322* (2013.01); *E05Y 2400/818* (2013.01); *E05Y 2900/106* (2013.01)

(58) Field of Classification Search

None

See application file for complete search history.

(56) References Cited

U.S. PATENT DOCUMENTS

| | | | | |
|---|---|---|---|---|
| 6,469,464 | B1 | 10/2002 | McCall | |
| 6,559,775 | B1 * | 5/2003 | King | E05F 15/40 340/10.1 |
| 6,836,209 | B2 | 12/2004 | Ploucha | |
| 7,365,635 | B2 | 4/2008 | Oberhauser | |
| 8,638,205 | B2 | 1/2014 | Boehme et al. | |
| 9,470,034 | B2 | 10/2016 | Ihlenburg et al. | |
| 9,640,005 | B2 * | 5/2017 | Geerlings | G07C 9/00309 |
| 9,715,825 | B2 * | 7/2017 | Geerlings | G08C 17/02 |
| 2005/0174077 | A1 * | 8/2005 | Haag | G01S 13/04 318/280 |
| 2007/0024431 | A1 * | 2/2007 | Touge | B60Q 9/00 340/436 |
| 2011/0215916 | A1 * | 9/2011 | Boehme | E05F 15/43 340/436 |
| 2013/0055639 | A1 * | 3/2013 | Brosseit | B60J 5/101 49/31 |
| 2014/0207344 | A1 * | 7/2014 | Ihlenburg | E05F 15/73 701/49 |
| 2017/0154482 | A1 | 6/2017 | Osborne | |
| 2019/0128040 | A1 * | 5/2019 | Mitchell | E05F 15/40 |

* cited by examiner

*Primary Examiner* — Gregory J Strimbu

(74) *Attorney, Agent, or Firm* — Frank Lollo; Eversheds Sutherland (US) LLP

(57) ABSTRACT

A vehicle includes a liftgate system for preventing a garage door from closing on a liftgate when the liftgate is open. The liftgate system includes the liftgate and a processor. The liftgate includes an external-facing sensor. The processor is to, when a garage door is open, determine whether the liftgate is in a closing path of the garage door. When the liftgate is in the closing path, the processor causes the liftgate to be lowered to an intermediate position between a fully open position and a fully closed position.

12 Claims, 3 Drawing Sheets

SYSTEMS AND METHODS FOR PREVENTING GARAGE DOOR FROM CLOSING ON OPENED-LIFTGATE

TECHNICAL FIELD

The present disclosure generally relates to systems and methods for operating a liftgate, and more specifically, systems and methods for preventing a garage door from closing on an open-liftgate.

BACKGROUND

Vehicles include a feature for automatically opening/closing their liftgates. Vehicles also include a feature for opening/closing a garage door. In many cases, a user may provide an input to close the garage door while the liftgate is opened and is within a closing path of the garage door. Such interaction may damage the liftgate or the garage door, thus, causing an inconvenience to the user.

SUMMARY

The appended claims define this application. The present disclosure summarizes aspects of the embodiments and should not be used to limit the claims. Other implementations are contemplated in accordance with the techniques described herein, as will be apparent to one having ordinary skill in the art upon examination of the following drawings and detailed description, and these implementations are intended to be within the scope of this application.

A Vehicle and a method is disclosed for preventing a garage door from closing on an open-liftgate. An example vehicle includes a liftgate and a processor. The liftgate includes an external-facing sensor. The processor is to, when a garage door is open, determine whether the liftgate is in a closing path of the garage door, and when the liftgate is in the closing path, lower the liftgate to an intermediate position between fully open and fully closed.

An example method of operating a liftgate of a vehicle includes determining, via a processor and an external-facing sensor, whether the liftgate is in a closing path of a garage door. The method further includes when the liftgate is in the closing path, lowering, via the processor, the liftgate to an intermediate position between fully open and fully closed.

BRIEF DESCRIPTION OF THE DRAWINGS

For a better understanding of the invention, reference may be made to embodiments shown in the following drawings. The components in the drawings are not necessarily to scale and related elements may be omitted, or in some instances proportions may have been exaggerated, so as to emphasize and clearly illustrate the novel features described herein. In addition, system components can be variously arranged, as known in the art. Further, in the drawings, like reference numerals designate corresponding parts throughout the several views.

DETAILED DESCRIPTION OF EXAMPLE EMBODIMENTS

Figure 1:
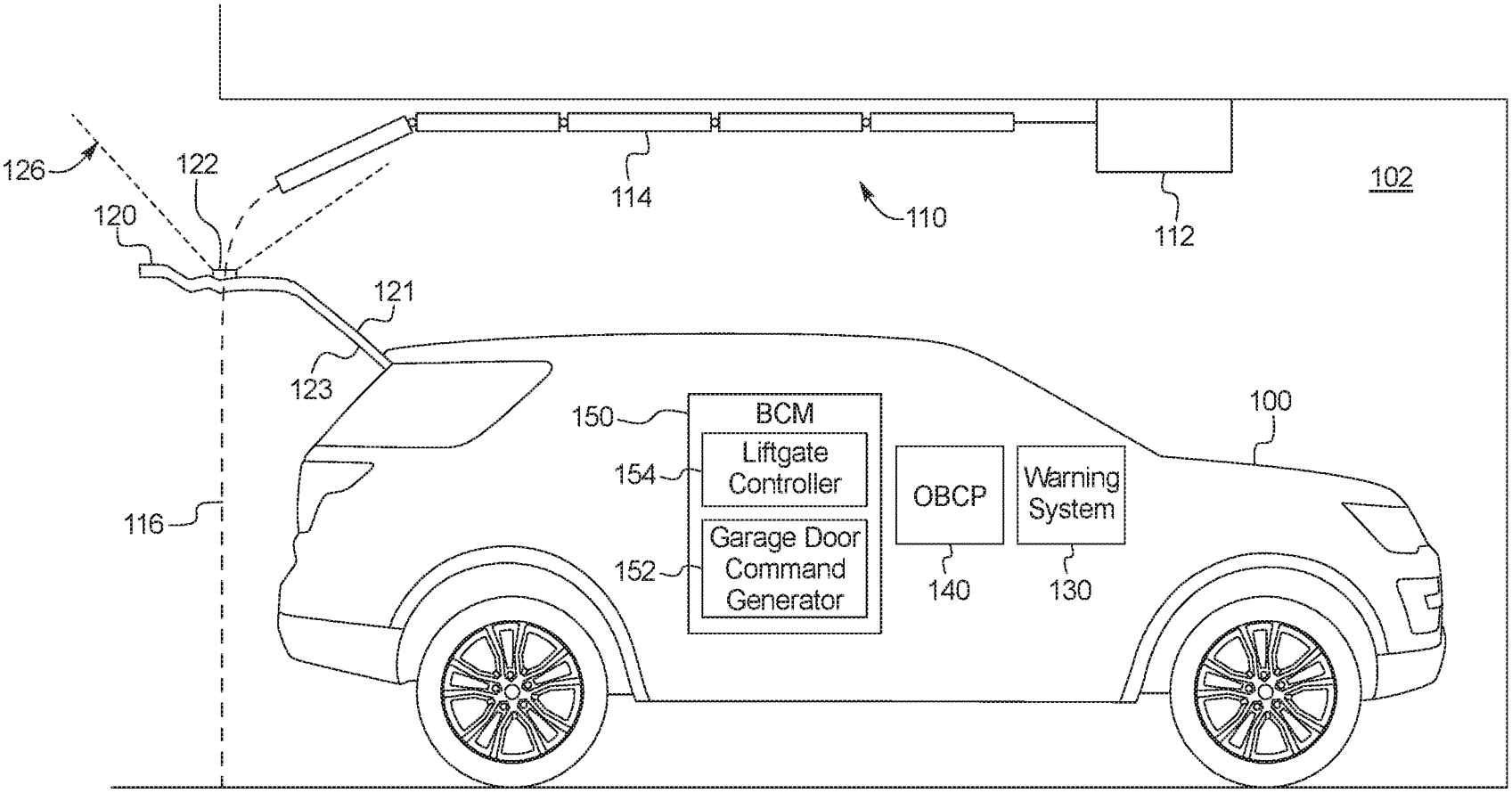
FIG. 1 illustrates a vehicle operating in accordance with this disclosure.

While the invention may be embodied in various forms, there are shown in the drawings, and will hereinafter be described, some exemplary and non-limiting embodiments, with the understanding that the present disclosure is to be considered an exemplification of the invention and is not intended to limit the invention to the specific embodiments illustrated.

Vehicles include features for automatically opening/closing garage doors. These vehicles provide a human machine interface (HMI) via, for example, a center console display or a mobile device (e.g., a smart phone, a smart watch, etc.) to receive a user input that causes a garage door to close or open. A user may attempt to close the garage door without noticing that the user's vehicle is within a closing path of the garage door. For example, a user's vehicle may be in a garage, and the liftgate and the garage door may be both opened. In such example, the user may close the garage door without realizing that the liftgate is in a closing path of the garage door, and consequently, the garage door may contact the liftgate. This contact may damage the liftgate and/or the garage door.

As used herein, a "liftgate" refers to a door or panel at a rear of a vehicle that opens upwardly to provide access to a trunk and/or another cargo area or compartment of the vehicle. In some examples, the liftgate includes a hatch that is coupled to a body of the vehicle (e.g., a sports-utility vehicle (SUV), a minivan, a hatchback. etc.) via a hinge located along an upper edge of a cargo area or compartment. In other examples, the liftgate includes a trunk lid that is coupled to a body of the vehicle (e.g., a sedan, a compact car, etc.) via a hinge along an outer edge of a trunk.

As described below, a liftgate system detects movement of a garage door and controls the position of a liftgate when the liftgate is in a travel path of the garage door.

The liftgate includes a sensor (e.g., an ultrasonic sensor, a camera, etc.) on the liftgate that faces externally from the rear of the vehicle. In some examples, a rear view camera transmits images to the liftgate system. The sensor detects the position and movement of the garage door. The liftgate system determines whether the vehicle is in a garage. In some example, the liftgate system analyzes measurements/images from one or more of the sensors and/or cameras to determine whether the vehicle is in the garage. Alternatively or additionally, in some example, the liftgate system uses global positioning system (GPS) data to determine whether the vehicle is parked in a garage (e.g., a location the vehicle is frequently stationary, etc.) When the vehicle is in a garage, the liftgate systems monitors whether the liftgate is opened. In some examples, the liftgate system analyzes the measurements and/or the images captured by the sensor on the liftgate. Alternatively or additionally, in some example, the liftgate system determines whether the garage door is open by communicating with a garage door system. The vehicle also includes a garage door control system that generates a command to operate the garage door in response to receiving a user input via an interface. The command is transmitted to a garage door system to control movements of a garage door.

When the liftgate system determines that (1) the vehicle is in a garage, (2) the liftgate and the garage door is opened, and (3) a command for closing the garage door has been transmitted, the liftgate system estimates whether the garage door will contact the liftgate. The liftgate system uses the rear view camera or the range detection sensors to estimate whether the liftgate intersects a closing path of the garage door. When the liftgate controller determines that the garage door will contact the liftgate, the liftgate system, via the garage door system, generates commands to stop and then open the garage door. After the garage door has been raised, the liftgate system lowers the liftgate without completely closing the liftgate. The liftgate system also provides a visual and/or audio warning. Additionally, the liftgate system prompts the user, via the HMI in the vehicle or on the mobile device, to indicate whether the user wishes to continue closing the garage. When the user indicates to continue closing the garage, the liftgate system continues to monitor the relationship between the position of the garage door and the new position of the liftgate, repeating the process described above when necessary.

FIG. 1 illustrates a vehicle 100 in accordance with this disclosure. In this illustrated example, the vehicle 100 is inside a garage 102. The garage 102 includes a garage door system 110. The garage door system 110 includes a garage door 114 and a garage door controller 112 for controlling movement of the garage door 114. In this illustrated example, the garage door controller 112 receives commands for opening, closing, or stopping the garage door 114 from the vehicle 100. In some examples, the garage door controller 112 receives the commands from an input device located within the garage 102 or from a hand-held device.

The vehicle 100 may be a standard gasoline powered vehicle, a hybrid vehicle, an electric vehicle, a fuel cell vehicle, and/or any other mobility implement type of vehicle. The vehicle 100 includes parts related to mobility, such as a powertrain with an engine, a transmission, a suspension, a driveshaft, and/or wheels, etc. The vehicle 100 may be a semi-autonomous vehicle (e.g., some routine motive functions, such as parking, are controlled by the vehicle 100), or an autonomous vehicle (e.g., motive functions are controlled by the vehicle 100 without direct driver input). In this illustrated example, the vehicle 100 includes a fifth door (e.g., van or a hatchback). The vehicle 100 includes a liftgate 120, a warning system 130, an on-board communication platform (OBCP) 140, and a body control module (BCM) 150.

The liftgate 120 is a door or panel hinged to the upper portion of an entrance to a cargo compartment located at the rear end of the vehicle 100. The liftgate 120 opens upwardly to provide access to a cargo compartment (not shown). The liftgate 120 includes an exterior surface 121 and an interior surface 123. The exterior surface 121 faces the external of the vehicle 100 when the liftgate 120 is closed. The liftgate 120 includes a motor (not shown), controlled by the BCM 150, that automatically opens and closes the liftgate 120. In some examples, the motor provides speed control that facilitates the BCM 150 controlling a speed at which the liftgate 120 opens and closes.

In this illustrated example, the liftgate 120 includes a rear view camera 122. The rear view camera 122 is disposed on the exterior surface 121. The rear view camera 122 is positioned on the exterior surface 121 such that a direction at which a center of a field-of-view (FOV) 126 of the camera 122 is directed to is generally perpendicular to the exterior surface 121. In the illustrated example, the rear view camera 122 is positioned to capture images of the area above the liftgate 120 when the liftgate 120 is opened. In some examples, the rear view camera 122 includes a motor (not shown) for changing the FOV 126. Additionally or alternatively, in some examples, the liftgate 120 includes range detection sensors (not shown). In such example, the range detection sensors may disposed on the exterior surface 121. The range detection sensors detect proximity of one or more objects relative to each of the range detection sensors. The range detection sensors may be ultrasonic sensors, radar, LiDAR, etc.

The OBCP 140 is communicatively coupled to the BCM 150 and the warning system 130. The OBCP 140 wirelessly pairs with a mobile device to commutatively couple the mobile device to the vehicle 100. In some examples, the OBCP 140 facilitates commutatively coupling multiple mobile devices with the vehicle 100. The OBCP 140 further includes wired or wireless network interfaces to enable communication with external networks. The OBCP 140 also includes hardware (e.g., processors, memory, storage, antenna, etc.) and software to control the wired or wireless network interfaces. The OBCP 140 includes controllers for standards-based networks (e.g., Global System for Mobile Communications ("GSM"), Universal Mobile Telecommunications System ("UMTS"), Long Term Evolution ("LTE"), Code Division Multiple Access ("CDMA"), WiMAX ("IEEE 802.16m"); and Wireless Gigabit ("IEEE 802.11ad"), etc. The OBCP 140 may also include one or more controllers for wireless local area networks such as a Wi-FI® controller (including IEEE 802.11 a/b/g/n/ac or others), a Bluetooth® controller (based on the Bluetooth® Core Specification maintained by the Bluetooth Special Interest Group), and/or a ZigBee® controller ("IEEE 802.15.4"), and/or a Near Field Communication ("NFC") controller, etc. Further, the external network(s) may be a public network, such as the Internet; a private network, such as an intranet; or combinations thereof, and may utilize a variety of networking protocols now available or later developed including, but not limited to, TCP/IP-based networking protocols.

The warning system 130 is communicatively coupled to the BCM 150. The warning system 130 generates a warning in response to receiving a command from the BCM 150. In some examples—the warning system 130 includes one or more speakers (not shown) for generating an audible warning. Alternatively or additionally, in some examples, the warning system 130 transmits a warning message via the OBCP 140 to the mobile device. In some example, the warning system 130 is coupled to one or more display devices (not shown) disposed in the vehicle 100 for visually displaying a warning. For example, the warning system 130 may display a warning on a center console display and/or a dashboard display. In some examples, the warning system 130 causes the light of the vehicle to flash.

The BCM 150 includes a garage door command generator 152 and a liftgate controller 154. The garage door command generator 152 generates a command to transmit to the garage door system 110 in response to receiving a user input. For example, the center console display may include a physical or soft button to receive the user input. The commands generated by the garage door command generator 152 include commands to open and close the garage door 114. In some examples, the commands also include a command to stop the motion of the garage door 114.

The liftgate controller 154 controls the liftgate 120 out of a closing path 116 of the garage door 114 in response to detecting that the liftgate 120 is within the closing path 116 while the garage door 114 is closing. The liftgate controller 154 controls motive functions of the liftgate 120, such as opening and closing the liftgate 120. The liftgate controller 154 initiates one of the motive functions in response to receiving a command. For example, the liftgate controller 154 may receive a command from an operator via an interface provided on a center console display of a vehicle infotainment system (not shown) or via the mobile device.

The liftgate controller 154 identifies whether the vehicle 100 is in a garage 102. In some examples, liftgate controller 154 acquires GPS data (e.g., from the OBCP 140) to determine whether the vehicle 100 is located in a garage 102. In some such examples, the liftgate controller 154 may learn over time the GPS coordinates of the garage 102. For example, the liftgate controller 154 may determine that a location is associated with the garage 102 when the vehicle 100 is frequently parked at that location (e.g., 3 or 4 times a week, etc.) for a threshold period of time (e.g., 5 or 6 hours, etc.). Alternatively or additionally, in some examples, the liftgate controller 154 uses machine learning, image recognition and/or object recognition to determine whether the vehicle 100 is located in a garage 102. based on measurements from the range detections sensors and/or images from the rear view camera 122. For example, the liftgate controller 154 may use the recorded information to recognize the environment of the garage 102. In such an example, the liftgate controller 154 may continue to record information when parked in an area to adaptively identify common features that constitute a garage (e.g., identifying a garage door, etc). Thus, when the vehicle 100 enters any garage, the liftgate controller 154 may readily recognize that the vehicle 100 is in a garage.

When the vehicle 100 is in the garage 102, the liftgate controller 154 determines whether the liftgate 120 is open. A liftgate motor (not shown) provides a signal that indicates the state of the liftgate 120 (e.g., open or closed). In some examples, the liftgate motor provides an angle at which the liftgate 120 is open. The liftgate controller 154 determines whether the garage door 114 is opened. In some examples, liftgate controller 154 uses the rear view camera 122 and/or the range detections sensors to detect whether the garage door 114 is opened. Alternatively, in some examples, the liftgate controller 154 communicates with the garage door controller 112 to determine whether the vehicle 100 garage door 114 is open.

When the vehicle 100 is in a garage 102 and the liftgate 120 and the garage door 114 are opened, the liftgate controller 154 uses the rear view camera 122 and/or the range detection sensors to determine whether the garage door 114 is closing. For example, the liftgate controller 154 may use the rear view camera 122 and/or the range detections sensors to monitor movements of a bottom edge of the garage door 114. Alternatively, in some examples, the liftgate controller 154 communicates with the garage door command generator 152 to detect whether a command to close the garage door 114 has been requested by the user.

When the garage door 114 is closing, the liftgate controller 154 uses the rear view camera 122 and/or the range detections sensors to determine whether the liftgate 120 is in the closing path 116 of the garage door 114. In some examples, the liftgate controller 154 may compares an image that is most recently captured by the rear view camera 122 to one or more previously captured images. Alternatively, in some examples, the liftgate controller 154 compares sensory data that are most recently generated by the range detection sensors to one or more previously generated sensory data. When liftgate controller 154 determines that the garage door 114 will contact the liftgate 120 (e.g., the liftgate 120 intersects the closing path 116), the liftgate controller 154 (1) instructs the garage door command generator 152 to generate a command to stop and/or open the garage door 114, (2) disables the garage door command generator 152 from generating commands in response to user inputs, and (3) instruct the center console or a mobile device wirelessly paired to the OBCP 140 to generate a warning to alert the user regarding the potential interaction.

Additionally, the liftgate controller 154 lowers the liftgate 120 to an intermediate position at which (a) the liftgate is not fully closed and (b) is not within the closing path 116 of the garage door 114. The liftgate controller 154 determines the intermediate position based on the current position of the liftgate 120, dimensions of the liftgate 120, and/or the closing path 116 of the liftgate 120, etc. This way, the vehicle 100 facilitates user access to the trunk or the cargo compartment of the vehicle 100 even when garage door 114 is fully closed.

Once the liftgate 120 is lowered, the liftgate controller 154 enables the garage door command generator 152 to generate commands in response to user inputs. The liftgate controller 154 prompts, via the center console or the mobile device, whether the user wishes the continue closing the garage door 114 and provide information regarding the status of the liftgate 120. When the garage door 114 resumes closing, the liftgate controller 154 continues to monitor the motion of the garage door 114 until the garage door 114 is fully closed.

In some examples, the liftgate controller 154 tracks an amount of time that the vehicle 100 is parked in the garage 102 and the liftgate 120 is open. In such examples, when the vehicle 100 is in a garage 102 and the garage door 114 and the liftgate 120 have been opened for a threshold amount of time (e.g., 10 minutes, 15 minutes, etc.), the liftgate controller 154 automatically closes the liftgate 120. In some such examples, the garage door command generator 152 generates a command to close the garage door 114 after the liftgate 120 is shut.

Figure 2:
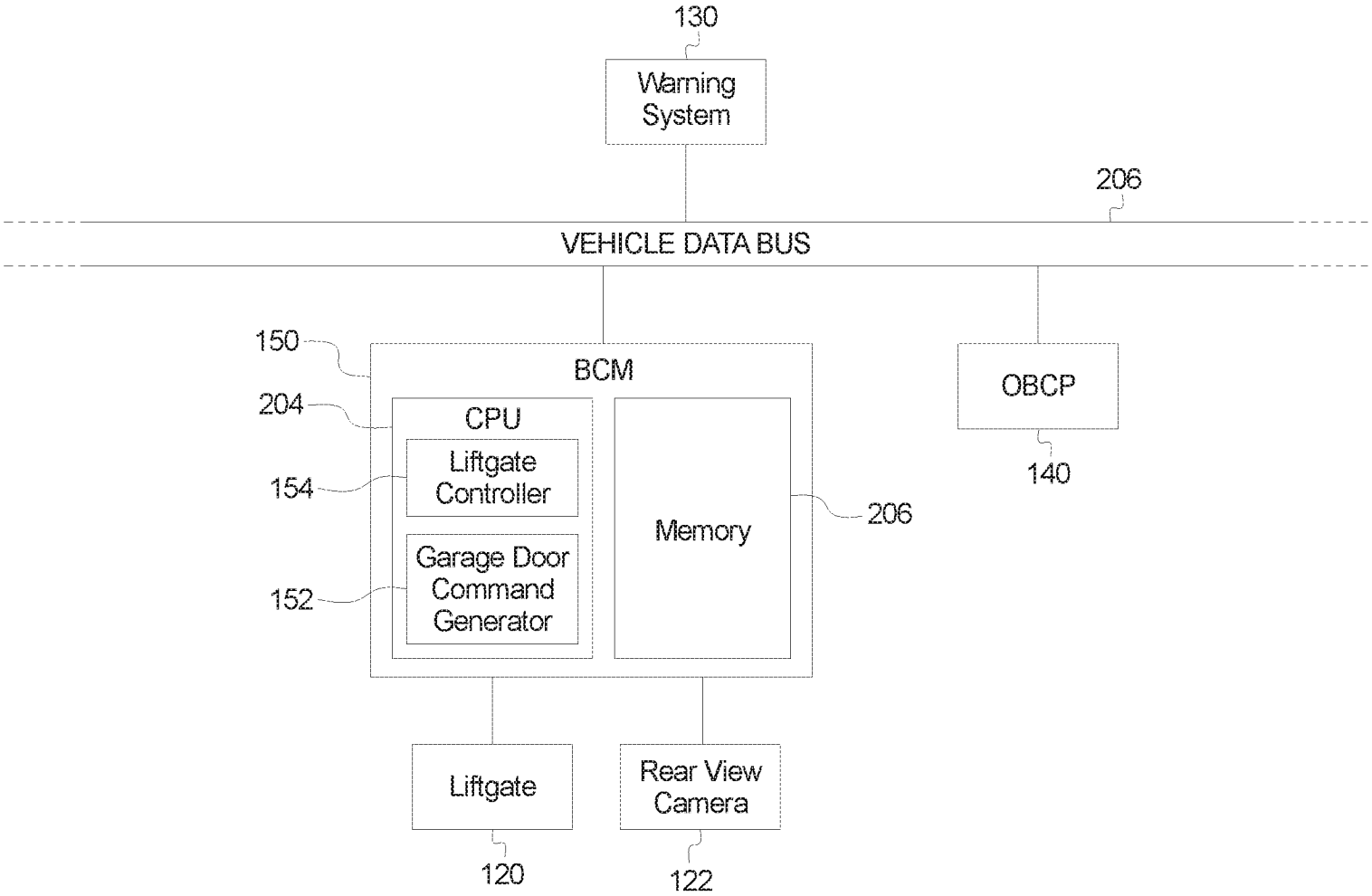
FIG. 2 block diagram of electronic components of the vehicle of FIG. 1.

FIG. 2 is a block diagram of electronic components 200 of the vehicle 100 of FIG. 1. In the illustrate example, the electronic components 200 include the warning system 130, the OBCP 140, the BCM 150, the liftgate 120, and the rear view camera 122, and avehicle data bus 202.

In the illustrated example, the BCM 150 includes a processor or controller 204 and memory 206. In the illustrated example, the BCM 150 is structured to include the liftgate controller 154 and the garage door command generator 152. Alternatively, in some examples, the liftgate controller 154 and the garage door command generator 152 incorporated into another electronic control unit (ECU) (e.g., a dedicated ECU for the liftgate 120 and/or the garage door command generator 152, etc.) with its own processor and memory (not shown). The processor or controller 202 may be any suitable processing device or set of processing devices such as, but not limited to: a microprocessor, a microcontroller-based platform, a suitable integrated circuit, one or more field programmable gate arrays (FPGAs), and/or one or more application-specific integrated circuits (ASICs). The memory 206 may be volatile memory (e.g., RAM, which can include non-volatile RAM, magnetic RAM, ferroelectric RAM, and any other suitable forms); non-volatile memory (e.g., disk memory, FLASH memory, EPROMs, EEPROMs, non-volatile solid-state memory, etc.), unalterable memory (e.g., EPROMs), read-only memory, and/or high-capacity storage devices (e.g., hard drives, solid state drives, etc). In some examples, the memory 206 includes multiple kinds of memory, particularly volatile memory and non-volatile memory.

The memory 206 is computer readable media on which one or more sets of instructions, such as the software for operating the methods of the present disclosure can be embedded. The instructions may embody one or more of the methods or logic as described herein. In a particular embodiment, the instructions may reside completely, or at least partially, within any one or more of the memory 206, the computer readable medium, and/or within the processor 204 during execution of the instructions.

The terms "non-transitory computer-readable medium" and "tangible computer-readable medium" should be understood to include a single medium or multiple media, such as a centralized or distributed database, and/or associated caches and servers that store one or more sets of instructions. The terms "non-transitory computer-readable medium" and "tangible computer-readable medium" also include any tangible medium that is capable of storing, encoding or carrying a set of instructions for execution by a processor or that cause a system to perform any one or more of the methods or operations disclosed herein. As used herein, the term "tangible computer readable medium" is expressly defined to include any type of computer readable storage device and/or storage disk and to exclude propagating signals.

The vehicle data bus 202 communicatively couples the warning system 130, the OBCP, and the BCM 150. In some examples, the vehicle 100 data bus includes one or more data buses. The vehicle data bus 202 may be implemented in accordance with a controller area network (CAN) bus protocol as defined by International Standards Organization (ISO) 11898-1, a Media Oriented Systems Transport (MOST) bus protocol, a CAN flexible data (CAN-FD) bus protocol (ISO 11898-7) and/a K-line bus protocol (ISO 9141 and ISO 14230-1), and/or an Ethernet™ bus protocol IEEE 802.3 (2002 onwards), etc.

Figure 3:
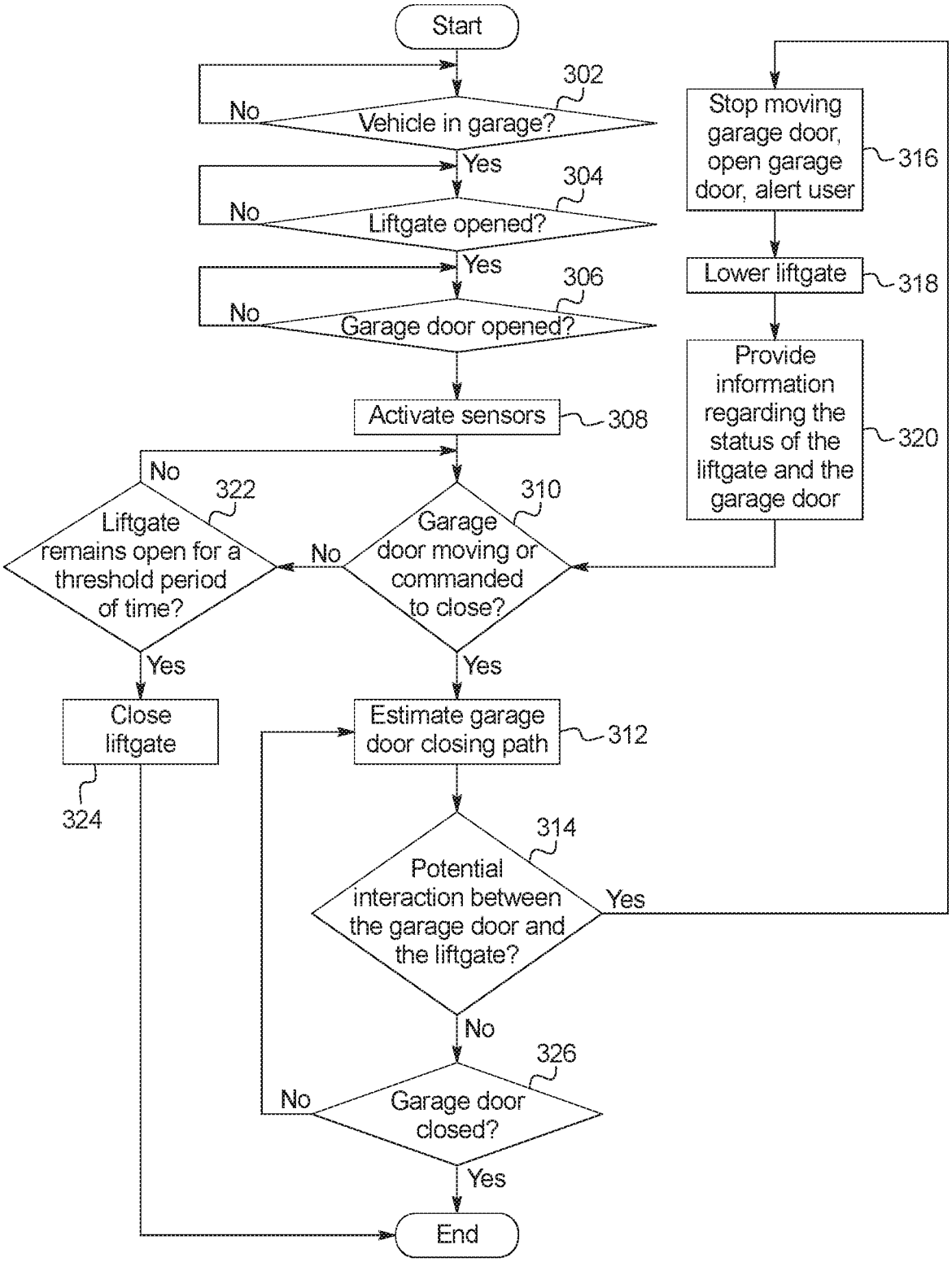
FIG. 3 is a flowchart of a method of operating a liftgate of FIG. 1.

FIG. 3 is a flowchart of a method for operating a liftgate 120, which may be implemented by the electronic components 200 of FIG. 2.

At block 302, the liftgate controller 154 determines whether the vehicle 100 is in a garage 102. For example, the liftgate controller 154 may use GPS data or machine learning to identify whether the vehicle 100 is in a garage 102. When the vehicle 100 is in a garage 102, the method continues to block 304. When the vehicle 100 is not in a garage 102, the method returns to block 302.

At block 304, the liftgate controller 154 determines whether the liftgate 120 is opened. When the liftgate 120 is opened, the method continues to block 306. When the liftgate 120 is not opened, the method returns to block 304.

At block 306, the liftgate controller 154 determines whether the garage door 114 is opened. For example, liftgate controller 154 may use the rear view camera 122 and/or the range detection sensors to detect whether the garage door 114 is opened. In alternative examples, the liftgate controller 154 communicates with the garage door controller 112 to determine whether the vehicle 100 garage door 114 is opened. When the garage door 114 is opened, the method continues to block 308. When the garage door 114 is not opened, the method continues to block 306.

At block 308, the liftgate controller 154 activates the rear view camera 122 and/or the range detection sensors.

At block 310, the liftgate 120 controller 154 determines whether the garage door 114 is closing. For example, the liftgate controller 154 may determine that the garage door 114 is closing when the garage door command generator 152 generates a command for closing the garage door 114. As another example, the liftgate controller 154 may monitor a motion of the garage door 114 to determine that the garage door 114 is closing. When the garage door 114 is closing, the method continues to block 312. When the garage door 114 is not closing, the method continues to block 322.

At block 312, the liftgate controller 154 estimates a closing path 116 of the garage door 114. For example, the liftgate controller 154 may compare an image that is most recently captured by the rear view camera 122 to one or more previously captured images. Alternatively, the liftgate controller 154 may compare sensory data that are most recently generated by the range detection sensors to one or more previously generated sensory data.

At block 314, the liftgate controller 154 determines whether the garage door 114 will contact the liftgate 120. For example, the liftgate controller 154 may use information regarding the current position of the liftgate 120, dimensions of the liftgate 120, and the closing path 116 of the liftgate 120 to calculate whether the garage door 114 will contact the liftgate 120. When the liftgate controller 154 determines that the garage door 114 will contact the liftgate 120, the method continues to block 316. When the liftgate controller 154 determines that the garage door 114 will not contact the liftgate 120, the method continues to block 326.

At block 316, the garage door command generator 152 generates a command for stopping and/or opening the garage door 114. At this time, the garage door command generator 152 is disabled from generating commands in response to user inputs. Additionally, the center console or a mobile device wirelessly paired to the OBCP 140 to generates a warning to alert the user regarding the potential interaction between garage door 114 and the liftgate 120.

At block 318, the liftgate controller 154 lowers the liftgate 120 to an intermediate position between fulling open and fully closed. The intermediate position is based on the dimensions of the liftgate 120 and the closing path 116 of the garage door 102.

At block 320, the liftgate controller 154, via the center console and/or the wirelessly paired mobile device, provides information regarding the status of the liftgate 120.

At block 322, the liftgate controller 154 determines whether the liftgate 120 has been opened for a threshold amount of time. When the liftgate 120 has been opened for a threshold amount of time, the method continues to block 324. When the liftgate 120 has not been opened for a predetermined amount of time, the method returns to block 310.

At block 324, the liftgate controller 154 closes the liftgate 120.

At block 326, the liftgate controller 154 determines whether the garage door 114 has been fully closed. When the garage door 114 is fully closed, the method ends. When the garage door 114 is not fully closed, the method returns to block 312.

The flowchart of FIG. 3 is representative of machine readable instructions stored in memory (such as the memory 206 of FIG. 2) that comprise one or more programs that, when executed by a processor (such as the processor 204 of FIG. 2), cause the vehicle 100 to implement the example liftgate controller 154 of FIG. 1. Further, although the example program(s) is/are described with reference to the flowcharts illustrated in FIG. 3, many other methods of implementing the example liftgate controller 154 may alternatively be used. For example, the order of execution of the blocks may be changed, and/or some of the blocks described may be changed, eliminated, or combined.

In this application, the use of the disjunctive is intended to include the conjunctive. The use of definite or indefinite articles is not intended to indicate cardinality. In particular, a reference to "the" object or "a" and "an" object is intended to denote also one of a possible plurality of such objects. Further, the conjunction "or" may be used to convey features that are simultaneously present instead of mutually exclusive alternatives. In other words, the conjunction "or" should be understood to include "and/or". As used here, the terms "module" and "unit" refer to hardware with circuitry to provide communication, control and/or monitoring capabilities, often in conjunction with sensors. "Modules" and "units" may also include firmware that executes on the circuitry. The terms "includes," "including," and "include"

are inclusive and have the same scope as "comprises," "comprising," and "comprise" respectively.

The above-described embodiments, and particularly any "preferred" embodiments, are possible examples of implementations and merely set forth for a clear understanding of the principles of the invention. Many variations and modifications may be made to the above-described embodiment(s) without substantially departing from the spirit and principles of the techniques described herein. All modifications are intended to be included herein within the scope of this disclosure and protected by the following claims.

What is claimed is:

1. A system comprising:

a vehicle having:

a liftgate with an external-facing sensor; and a processor adapted to:

determine, based on sensor data from the external-facing sensor, a closing path of a garage door in response to a garage door close command, wherein the garage door is external to the vehicle;

determine whether the liftgate is in the closing path of the garage door; and based on the determination that the liftgate is in the closing path, lower the liftgate to an intermediate position between a fully open position and a fully closed position.

2. The system of claim 1, wherein the intermediate position is a position in which the liftgate is not in the closing path.

3. The system of claim 1, wherein the step of determining whether the liftgate is in the closing path of the garage door comprises:

determining, with the external-facing sensor, whether of the garage door is moving.

4. The system of claim 3, wherein the processor transmits, via antennas, a garage door stop command when the liftgate is in the closing path.

5. The system of claim 1, wherein the processor is adapted to determine that the liftgate is open for a threshold period of time; and the step of determining whether the liftgate is in the closing path is based on the garage door close command and the determination that the liftgate is open.

6. The system of claim 1, wherein the processor is adapted to transmit, from the vehicle to a mobile device, via antennas, a status of the garage door and a status of the liftgate after the liftgate is in the intermediate position.

7. A method of operating a liftgate of a vehicle comprising:

determining, via a processor in the vehicle, a closing path of a garage door based on sensor data from an external-facing sensor on the liftgate in response to a garage door close command, wherein the garage door is external to the vehicle;

determining, via the processor, whether the liftgate is in the closing path of the garage door; and based on the determination that the liftgate is in the closing path, lowering via the the liftgate, via the processor, to an intermediate position between a fully open position and a fully closed position.

8. The method of claim 7, further comprising:

determining that the liftgate is open for a threshold period of time; and wherein the step of determining whether the liftgate is in the closing path is based on the garage door close command and the determination that the liftgate is open.

9. The method of claim 7, wherein the intermediate position is a position in which the liftgate is not in the closing path.

10. The method of claim 7, wherein the step of determining, via the processor, whether the liftgate is in the closing path of the garage door comprises determining, with the external-facing sensor, whether the garage door is moving.

11. The method of claim 10, further comprising, responsive to the liftgate being in the closing path, transmitting, via antennas, a garage door stop command.

12. The method of claim 7, further comprising, transmitting, from the vehicle to a mobile device, via antennas, a status of the garage door and a status of the liftgate after the liftgate is in the intermediate position.

* * * * *